US010231578B2

(12) United States Patent
Rayner

(10) Patent No.: US 10,231,578 B2
(45) Date of Patent: Mar. 19, 2019

(54) SAFETY DEVICE

(71) Applicant: Quacks Innovation Limited, Kingston-upon-Thames (GB)

(72) Inventor: Simon Rayner, Kingston-upon-Thames (GB)

( * ) Notice: Subject to any disclaimer, the term of this patent is extended or adjusted under 35 U.S.C. 154(b) by 616 days.

(21) Appl. No.: 14/881,099

(22) PCT Filed: Apr. 9, 2014

(86) PCT No.: PCT/GB2014/051097

§ 371 (c)(1),
(2) Date: Oct. 12, 2015

(87) PCT Pub. No.: WO2014/167317

PCT Pub. Date: Oct. 16, 2014

(65) Prior Publication Data

US 2018/0192828 A1 Jul. 12, 2018

(30) Foreign Application Priority Data

Apr. 12, 2013 (GB) ..... 1306677.4

(51) Int. Cl.
*A47K 17/00* (2006.01)
*A47K 3/00* (2006.01)

(52) U.S. Cl.
CPC ..... *A47K 3/005* (2013.01)

(58) Field of Classification Search
CPC ..... A47K 17/00
USPC ..... 4/661
See application file for complete search history.

(56) References Cited

U.S. PATENT DOCUMENTS 5,337,956 A * 8/1994 Crutcher ..... B05B 17/08 239/211

OTHER PUBLICATIONS

Anonymous:"Material Instinct:Bath Time Fun with Ozzie the Octopus!", Mar. 31, 2010 (Mar. 31, 2010)XP055126280;URL: http://materialinstinct.blogspot.nl/2010/03/bath-time-fun-with-ozzie-octopus.html [retrieved Jul. 1, 2014].*

* cited by examiner

*Primary Examiner* — Lori Baker
(74) *Attorney, Agent, or Firm* — Sukovic Law P.C.; Milena Sukovic

(57) ABSTRACT

A safety device: including a first internal chamber and an attachment arrangement to allow the device to be attached to a fluid delivery spout, so that fluid delivered through the spout is directed into the first internal chamber. At least one first exit conduit having a first end in communication with the first internal chamber and at least one second exit conduit having a first end in communication with the fluid inlet. The first internal chamber and first exit conduit are separated from the fluid inlet and second exit conduit so that fluid entering the device through the attachment arrangement and passing through the device to the second end of the first exit conduit will not come into contact with fluid entering the device through the fluid inlet and passing through the device to the second end of the second exit conduit.

17 Claims, 3 Drawing Sheets

SAFETY DEVICE

CROSS-REFERENCE TO RELATED APPLICATIONS

This application is U.S. National Phase of PCT Application No. PCT/GB2014/051097 filed Apr. 9, 2014, which claims priority to Application No. GB1306677.4 filed on Apr. 12, 2013, the disclosures of which are incorporated in their entirety by reference herein.

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC OR AS A TEXT FILE VIA OFFICE ELECTRONIC FILING SYSTEM (EFS-WEB)

Not applicable

STATEMENT REGARDING PRIOR DISCLOSURE BY THE INVENTOR OR A JOIN INVENTOR

Not applicable

BACKGROUND OF THE INVENTION

Field of the Invention

This invention relates to a safety device, and in particular concerns a safety device for use in a bath.

With many designs of bath tub, the tap or taps often project into the space within, or immediately above, the bath tub itself. Taps are generally formed from a very hard material such as metal, and can comprise sharp edges. Striking a part of one's body against a tap is therefore a hazard when using a bath. This is particularly the case for children or disabled people, who may have reduced awareness and/or coordination.

Description of Related Art including information disclosed under 37 C.F.R. 1.97 and 1.98

It has previously been proposed to provide a tap protector, comprising a relatively soft body which fits over the free end of the tap. If a user bumps into the tap protector, the likelihood of injury and/or discomfort will be greatly reduced compared to striking the bare tap.

BRIEF SUMMARY OF THE INVENTION

Tap protectors may be moulded into a shape that will be appealing to children, for instance that of an animal.

It is an object of the present invention to provide an improved tap protector.

Accordingly, one aspect of the present invention provides a safety device comprising: a main body comprising a first internal chamber; an attachment arrangement to allow the device to be attached to a fluid delivery spout, so that fluid delivered through the spout is directed into the first internal chamber; at least one first exit conduit having a first end in communication with the first internal chamber and having an open second end; a fluid inlet, into which fluid can be introduced into the device; and at least one second exit conduit having a first end in communication with the fluid inlet and having an open second end, wherein the first internal chamber and first exit conduit are separated from the fluid inlet and second exit conduit so that fluid entering the device through the attachment arrangement and passing through the device to the second end of the first exit conduit will not come into contact with fluid entering the device through the fluid inlet and passing through the device to the second end of the second exit conduit.

DETAILED DESCRIPTION OF THE INVENTION

Advantageously, the safety device comprises a first part which comprises the main body, the attachment arrangement and the first exit conduit, and a second part, which includes the fluid inlet and the second exit conduit.

Preferably, the first and second parts are attached together.

Conveniently, the first and second parts are formed integrally with one another.

Advantageously, the first part defines a substantially enclosed passage defining a first fluid path between the first internal chamber and the open second end of the at least one first exit conduit.

Preferably, the second part defines a substantially enclosed passage defining a second fluid path between the fluid inlet and the open second end of the at least one second exit conduit.

Conveniently, one or both of the first and second parts comprises upper and lower layers of material which are attached to one another around at least a region of their edges.

Advantageously, the attachment arrangement comprises an aperture, into which the free end of a fluid delivery spout may be inserted.

Preferably, the attachment arrangement comprises a fastening arrangement to allow the device to be fastened to the fluid delivery spout.

Conveniently, the fastening arrangement comprises an elongate flexible member which may be wrapped around the fluid delivery spout.

Advantageously, the flexible member has two cooperating attachment regions which may be releasably attached to each other.

Preferably, the safety device has a plurality of first exit conduits.

Conveniently, the safety device has a plurality of second exit conduits.

Advantageously, the safety device is formed at least mainly from a flexible material.

Preferably, the safety device is formed at least mainly from a neoprene or EVA material.

Conveniently, the safety device is a tap protector.

Another aspect of the invention provides a method of diverting fluid, comprising placing a safety device according to any preceding claim over a fluid delivery spout, so that fluid delivered through the spout is directed into the first internal chamber.

Figure 2:
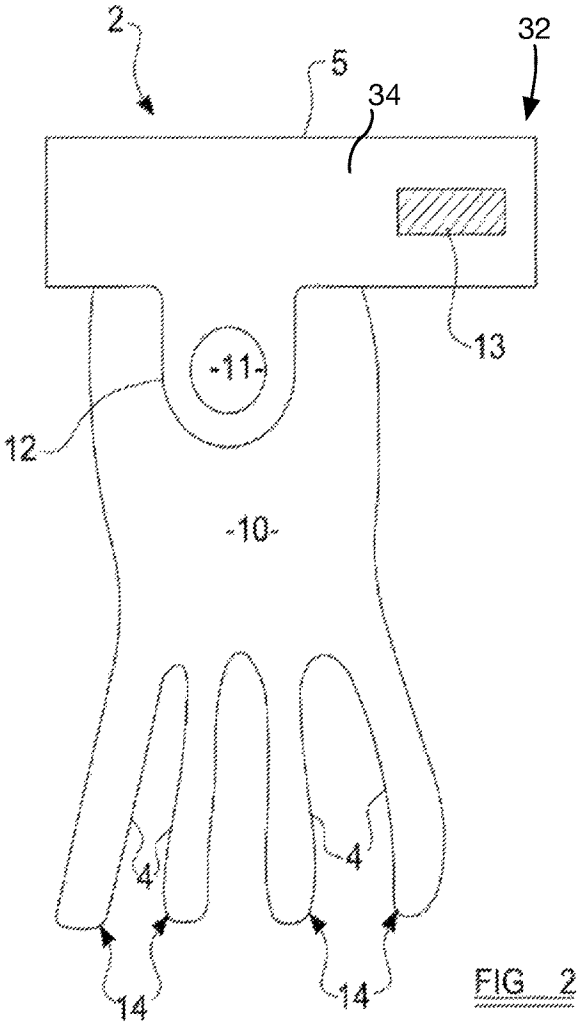
FIG. 2 shows a second side of a first part of a device embodying the present invention.
Figure 1:
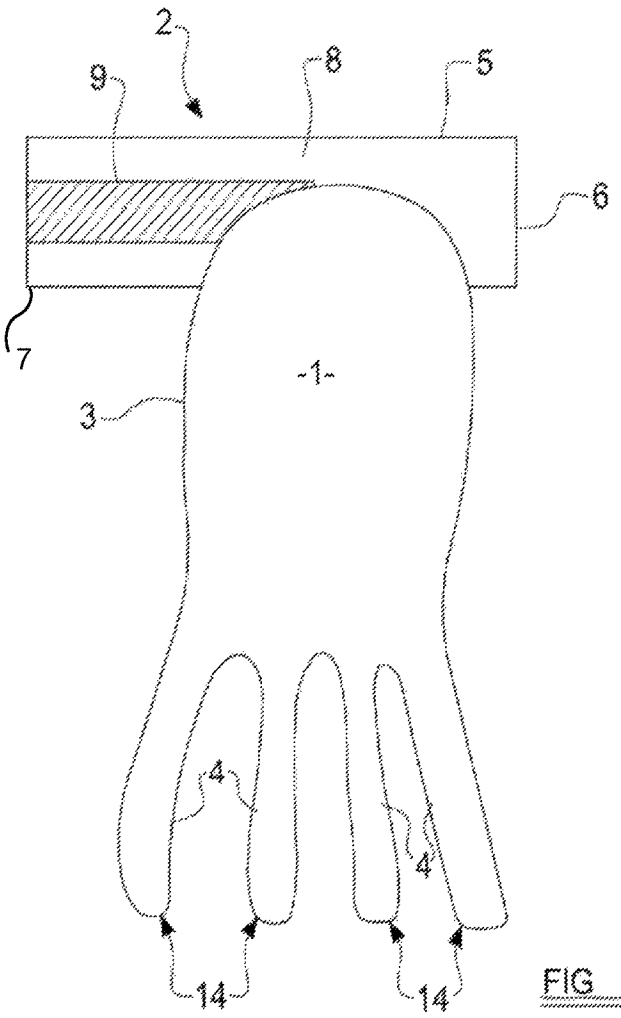
FIG. 1 shows a first side of a first part of a device embodying the present invention.
Figure 4:
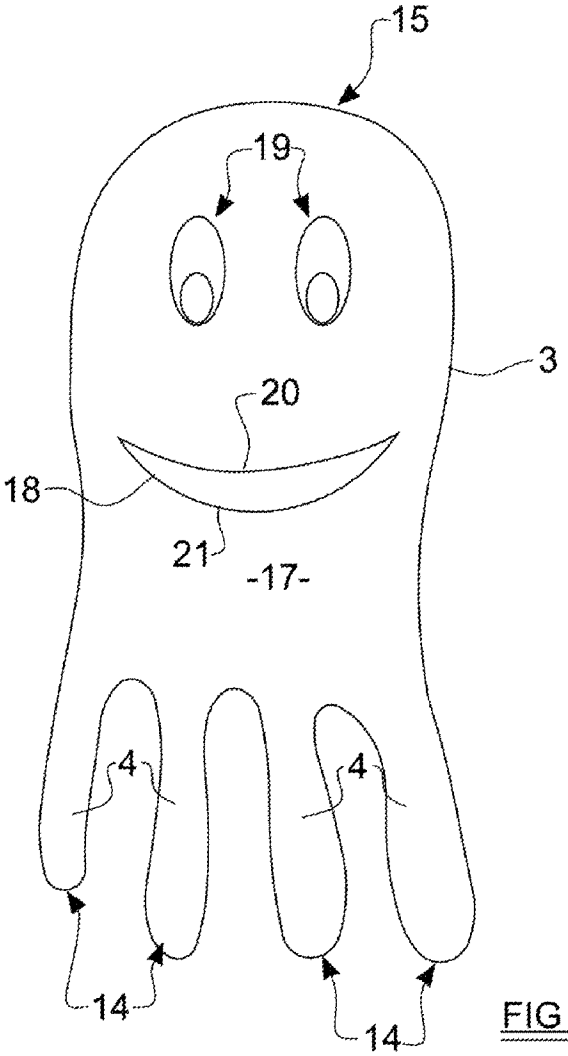
FIG. 4 shows a second side of a second part of the device.
Figure 3:
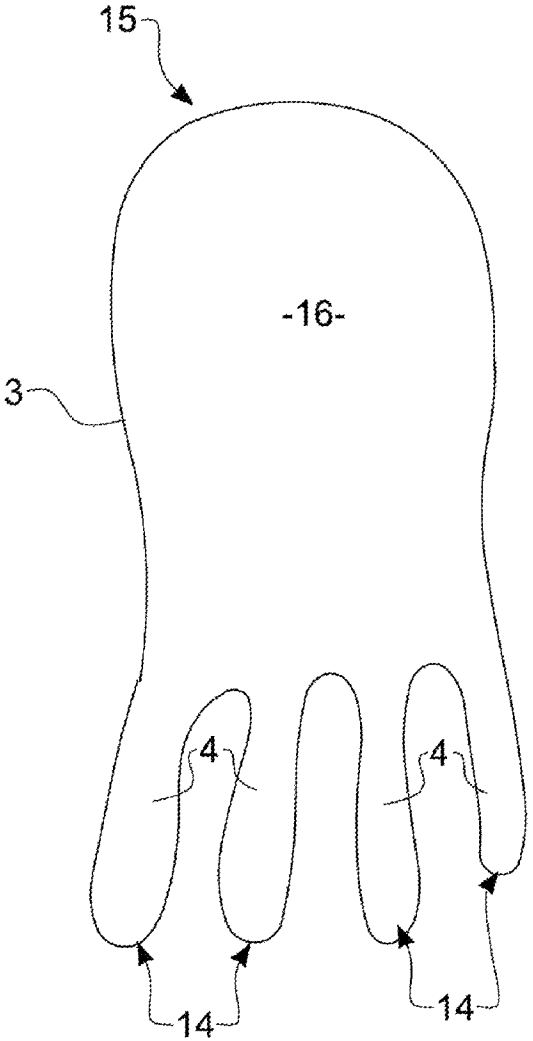
FIG. 3 shows a first side of a second part of the device.
Figure 5:
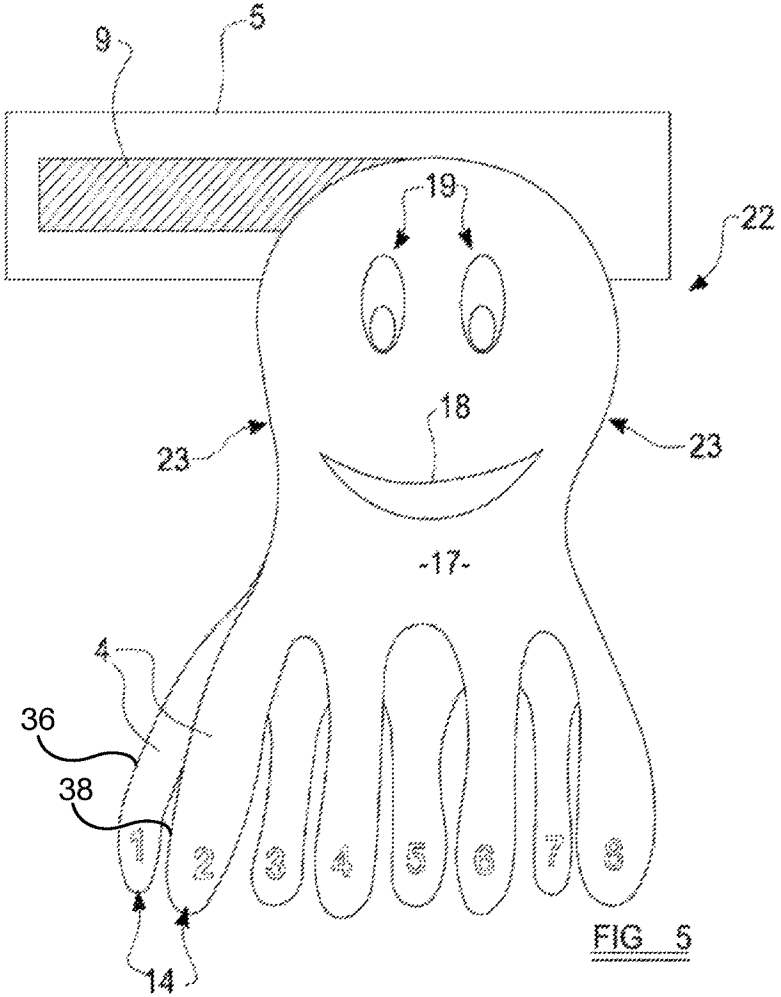
FIG. 5 shows the assembled device.

In order that the invention may be more readily understood embodiments thereof will now be described, by way of example, with reference to the accompanying drawings, in which:

FIGS. 1 and 2 show first and second sides of a first part of a device embodying the present invention;

FIGS. 3 and 4 show first and second sides of a second part of the device;

FIG. 5 shows the assembled device; and

Figure 6:
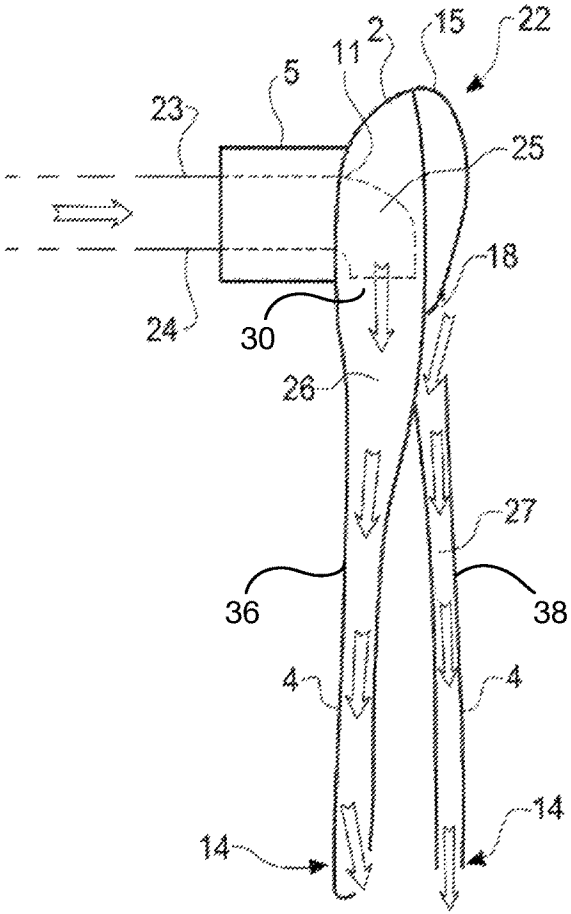
FIG. 6 shows the device in use.

FIG. 6 shows the device in use.

Referring firstly to FIG. 1, a first (i.e. front) side 1 of a first part 2 of a safety device embodying the present invention is shown. The first side 1 is formed from a continuous layer of a flexible material. The material is preferably a soft, impact-absorbing material with low thermal conductivity. Examples of a suitable material include synthetic rubbers such as neoprene materials, as well as ethylene-vinyl acetate (EVA), although other materials may be used. It is preferred that the material is substantially waterproof, although neoprene and EVA materials may absorb some water (but can easily be dried again). Importantly, the material should not allow water to pass through over short timescales.

The first side 1 is generally in the shape of an octopus, having a bulbous main part 3 with a number of tentacles 4 protruding from one side (i.e. the lower side) of the main part 3. In the embodiment shown there are four tentacles 4, and the reasons for this will become clear below.

In an embodiment, a fastening arrangement 32 includes as embodiment of a flexible member 34. An embodiment of a flexible member 34 is elongate strip 5.

Attached to a rear side of the first part 2 is an elongate strip 5 of material. The strip 5 is attached to the first part 2, and is offset with respect to the main part 3 so that the attachment location is nearer to one end 6 of the strip 5 than the other end 7. The strip 5 is attached to the far end of the main part 3 from the side from which the tentacles 4 protrude. The strip 5 extends away from the main part 3 in a direction which is generally perpendicular to the direction in which the tentacles 4 protrude.

Provided on the front side 8 of the strip 5 is a first region of an attachment material 9, which for instance may include a Velcro-type fastener. The first region of the attachment material 9 extends generally between the main part 3 and the second end 7 of the strip 5.

Referring to FIG. 2, the second (i.e. rear) side 10 of the first part 2 is shown. The second side 10 of the first part 2 is formed from a further sheet of flexible, waterproof material, and may for instance be formed from the same material as the first side 1. The further sheet of material is generally the same shape as, and overlies, the sheet of material that forms the first side 1.

A tap aperture 11 is formed through the second side 10. The tap aperture 11 is, in the depicted embodiment, generally circular, and is of sufficient size that the distal end of a regular tap (not shown) may be inserted through the tap aperture 11. In preferred embodiments the diameter of the tap aperture 11 may be around 2-5 cm, and more preferably around 3-4 cm, although for some applications the diameter of the tap aperture 11 may be even larger, perhaps as large as 10 cm. It is envisaged that the tap aperture 11 may also have a larger or smaller diameter than this. Where the tap aperture is not substantially circular, the dimensions given above may refer to the largest dimension of the aperture.

The strip 5 of material has a protruding section 12 that extends from the main part of the strip 5, is attached to the further sheet of material and surrounds the tap aperture 11, thus reinforcing the tap aperture 11. The protruding section 12 also has an aperture therethrough, so as not to obstruct access to the tap aperture 11.

On the rear side of the strip 5, a further region of an attachment material 13 is formed. In preferred embodiments, the regions of attachment material 9, 13 provided on the front and rear sides of the strip 5 comprise cooperating Velcro fasteners, although of course other types of fastener may be used.

The sheets of material which from the first and second sides 1, 10 are formed are sealed together substantially all of the way around their edges, with the exception of the free ends 14 of the tentacles 4. The sheets of material are not joined together in these locations, and so each tentacle 4 has a free end 14 that is open.

It will be understood that, within the main part 3 of the second part 2, a generally enclosed interior chamber is formed, between the sheets of material that form the first and second sides 1, 10. Fluid may be introduced into this internal chamber through the tap aperture 11. Fluid introduced through the tap aperture 11 may (if the first part 2 is oriented with the tentacles facing downwards) run downwards through the internal chamber under the force of gravity, through the hollow interior of each tentacle 4, and out of the free ends 14 of the tentacles 4. If fluid is introduced into the tap aperture 11 under higher pressure, the fluid will be driven out of the free ends 14 of the tentacles regardless of the orientation of the first part 2.

A first fluid path is therefore defined between the tap aperture 11 and the free ends 14 of the tentacles 4.

In an embodiment, a tentacle 4 of first part 2 is an example of a first exit conduit 36.

Turning now to FIGS. 3 and 4, a second part 15 of the safety device is shown. FIG. 3 shows a first (i.e. rear) side 16 of the second part 15. The first side 16 is formed from a single, continuous sheet of a flexible, waterproof material. In the embodiments shown this sheet is of approximately the same shape as the sheets which form first and second sides 1, 10 of the first part 2, having a bulbous main section 3 with four tentacles 4 protruding from one side thereof. In preferred embodiments the first side 16 of the second part 15 does not have any apertures formed therethrough.

FIG. 4 shows a second (i.e. front) side 17 of the second part 15. Once again, the second side 17 is formed from a single, continuous sheet of a flexible, waterproof material, and has a shape which corresponds to that of the first side 16.

The second side 17 has an inlet aperture 18 formed therethrough, and in the depicted embodiment the inlet aperture 18 is formed generally within the bulbous main part 3. In the embodiment shown, the inlet aperture 18 is crescent-shaped, to resemble a smiling mouth, and a pair of eyes 19 are drawn on the second side 17 above the inlet aperture 18, so that the overall impression is that of a smiling face.

The inlet aperture 18 has a first edge 20, which is furthest from the tentacles 4 (corresponding to the upper edge of the mouth). This first edge 20 may be attached to the sheet that forms the first side 16. The inlet aperture 18 has a second edge 21, which is nearest to the tentacles 4 (corresponding to the lower edge of the mouth), and this edge 21 is not attached to the first side 16.

Once again, the sheets of material forming first and second sides 16, 17 are attached to one another around their edges, with the exception of the free ends 14 of the tentacles 4.

It will be understood that a fluid path exists between the inlet aperture 18 and the free end 14 of each tentacle 4. Fluid may therefore be introduced into the inlet aperture 18 and will, if the second part 15 is oriented with the tentacles 4 facing downwardly, run downwardly through the hollow interior of the second part 15, through the hollow interior of each tentacle 4, and out of the free ends 14 of the tentacles 4.

In this embodiment the first and second parts 2, 15 are initially formed separately from each other. In order to form the finished safety device 22, the second part 15 is overlaid on the first part 2, so that the bulbous main parts 3 of the first and second parts 2, 15 are substantially aligned. Regions of the outer edges of the main parts 3 are then attached together, although the tentacles 4 of each part 2, 15 are not attached together. In preferred embodiments one or more regions of the main parts 3 furthest from the tentacles 4 are attached together. FIG. 5 shows the assembled safety device 22 and, in this embodiment, the outer edges of the first and second parts 2, 15 are attached together generally between the two points indicated by reference numeral 23.

It will be understood that the inlet aperture 18 is presented on the front surface of the safety device 22, and the tap aperture 11 (not visible in FIG. 5) is presented on the rear surface of the safety device 22.

In preferred embodiments the first and second parts 2, 15 are shaped so that, when they are attached together to form the finished safety device 22, the tentacles 4 of the two parts 2, 15 do not overlie one another and are spaced apart, so that the tentacles 4 of the first part 2 are visible between the tentacles 4 of the second part 15 when the safety device 22 is viewed generally head-on. This gives the impression of an octopus with eight tentacles in total.

In the depicted embodiment numerals 1 to 8 are printed near the free ends 14 of the tentacles 4, thus providing a further educational aspect to the safety device 22.

In an embodiment, a tentacle 4 of second part 15 is an example of a second exit conduit 38.

Referring to FIG. 6, a cut-away side view of the safety device 22 in use is shown.

A tap 23 has a generally straight main part 24, and bends downwardly at its free end to form a downward-facing outlet 25.

The free end of the tap 23 is inserted into the tap aperture 11, and the strip 5 of material is wrapped around the main part 24 of the tap 23, and then secured in place using the regions of fastening material 9, 13. It will be understood that the elongate, flexible strip 5 allows the device 22 to be releasably secured firmly easily to taps of different shapes and dimensions.

If fluid is ejected from the tap 23, the fluid will enter the internal chamber of the first part 2 of the device 22, and will follow a first fluid path 26 through the interior of the first part 2, passing through the hollow interior of one or more of the tentacles 4 and out of the free end 14 of the or each tentacle 4.

It should be noted that the end of the tap 23 is entirely covered by the safety device 22, and if a person strikes a part of his/her body against the tap 23, the impact will be significantly lessened.

It should also be appreciated that, if a child accidentally turns on the tap 23, the water that comes out of the tap 23 will (if the device 22 is correctly oriented) be channelled safely downwards through the tentacles 4 of the first part 2, and will not spray upwardly or outwardly. This may be a particularly advantageous safety feature if the tap 23 that is covered by the safety device 22 is a hot tap.

Furthermore, fluid may be introduced into the inlet aperture 18 which is presented on the front surface of the safety device 22. If fluid is introduced into the inlet aperture 18, the fluid will follow a second fluid path 27 through the interior of the second part 15, through the hollow interior of the tentacles 4 of the second part 15, and out through the free ends 14 of the tentacles 4.

The front part of the safety device 22 may therefore provide a diverting game for children, who may pour bathwater in through the inlet aperture 18 (which takes the form of a smiling mouth of the octopus), and this water will then flow out of the free ends of some of the tentacles 4.

It should be noted, however, that the first and second fluid paths 26, 27 are separate from one another, and fluid flowing along the first fluid path 26 will not mix with or meet fluid flowing along the second fluid path 27.

The safety device 22 therefore provides protection against individuals bumping into the tap 23, and also from water flowing through the tap 23. Furthermore, the front part (i.e. second part 15 of the safety device 22) provides extra layers of cushioning and thermal insulation, whilst at the same time providing an entertaining game for bathers to play.

Some taps may deliver water at a relatively high pressure. If this is the case, relatively narrow conduits, such as those shown in the attached figures, may not be of sufficient width to channel all of the water delivered by the tap, and water may spray backwards out through the tap aperture 11. To alleviate this problem, wider conduits may be provided. For example, referring to FIG. 1, the regions of the sheets of material forming the upper and lower layers 1, 10 of the first part 2 may not be joined to each other in the regions between the left-most tentacle 4 and the second left-most tentacle 4, and also between the right-most tentacle 4 and the second right-most tentacle 4. It will be appreciated that this will provide a significantly greater area through which water may flow to leave the internal chamber formed within the first part 2.

A design may also be chosen which includes fewer, wider conduits. For instance, the device may be formed in the shape of a side-on dog, with two conduits being formed by the relatively wide legs of the dog. As a possible alternative, the device may be formed in a more simple shape, such as that of a windmill, with the entire lower edge of the device being left open. This will provide a single, relatively wide conduit that will have the capacity to channel relatively high rates of flow.

In the embodiments disclosed above, the device 22 is formed from first and second parts 2, 15, each of which is formed from two sheets of material. In alternative embodiments, the device may be formed from only three sheets of material, with the second part being defined between the rear layer of material and a middle layer of material, and the first part being defined by the middle layer of material and in the front layer of material.

It should also be appreciated that the device may be constructed in any convenient manner, not limited to the techniques described above. For instance, either of the first and second parts may be formed from a single sheet of material that is folded over on itself at one edge, and has free edges attached together, rather than being formed from two separate sheets of material.

As a further example, either or both of the first and second parts may be moulded as a single piece. Indeed, the entire device may be moulded as a single piece, and skilled readers will appreciate how this may be achieved.

In the above embodiment, the safety device 22 takes the form of an octopus. The skilled reader will, however, readily appreciate how the principles set out in the specification may be used to form other designs of safety device, including but not limited to other types of animal, vehicles, trees and plants, human figures and buildings.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

SEQUENCE LISTING

Not applicable

The invention claimed is:

1. A safety device comprising:

a main body comprising a first internal chamber;

an attachment arrangement comprising a tap aperture presented on the rear surface of the device to allow the device to be attached to a fluid delivery spout, so that fluid delivered through the spout is directed into the first internal chamber;

at least one first exit conduit having a first end in communication with the first internal chamber and having an open second end;

a fluid inlet presented on the front surface of the device, into which fluid can be introduced into the device; and at least one second exit conduit having a first end in communication with the fluid inlet and having an open second end, wherein the first internal chamber and first exit conduit are separated from the fluid inlet and second exit conduit so that, when the free end of a fluid delivery spout is inserted into the tap aperture, and the device is correctly oriented, fluid entering the device through the attachment arrangement and passing through the device to the second end of the first exit conduit will be channelled downwards through the first exit conduit and will not come into contact with fluid entering the device through the fluid inlet and passing through the device to the second end of the second exit conduit.

2. A safety device according to claim 1, comprising a first part which comprises the main body, the attachment arrangement and the first exit conduit, and a second part, which includes the fluid inlet and the second exit conduit.

3. A safety device according to claim 2 wherein the first and second parts are attached together.

4. A safety device according to claim 2 wherein the first and second parts are formed integrally with one another.

5. A safety device according to claim 2 wherein the first part defines a substantially enclosed passage defining a first fluid path between the first internal chamber and the open second end of the at least one first exit conduit.

6. A safety device according to claim 2 wherein the second part defines a substantially enclosed passage defining a second fluid path between the fluid inlet and the open second end of the at least one second exit conduit.

7. A safety device according to claim 2 wherein one or both of the first and second parts comprises upper and lower layers of material which are attached to one another around at least a region of their edges.

8. A safety device according to claim 2 wherein the attachment arrangement comprises the tap aperture, into which the free end of a fluid delivery spout may be inserted.

9. A safety device according to claim 2 wherein the attachment arrangement comprises a fastening arrangement to allow the device to be fastened to the fluid delivery spout.

10. A safety device according to claim 8 wherein the fastening arrangement comprises an elongate flexible member which may be wrapped around the fluid delivery spout.

11. A safety device according to claim 10 wherein the flexible member has two cooperating attachment regions which may be releasably attached to each other.

12. A safety device according to claim 2 having a plurality of first exit conduits.

13. A safety device according to claim 2 having a plurality of second exit conduits.

14. A safety device according to claim 2 formed at least mainly from a flexible material.

15. A safety device according to claim 14 formed at least mainly from a neoprene or EVA material.

16. A safety device according to claim 2, wherein the safety device is a tap protector.

17. A method of diverting fluid, comprising placing a safety device according to any preceding claim over a fluid delivery spout, so that fluid delivered through the spout is directed into the first internal chamber.

* * * * *